US012319387B2

(12) United States Patent
Maher et al.

(10) Patent No.: US 12,319,387 B2
(45) Date of Patent: Jun. 3, 2025

(54) GAP COMPRESSION GUIDES FOR SHIPPING CONTAINERS

(71) Applicant: Trendsetter Vulcan Offshore, Inc., Houston, TX (US)

(72) Inventors: James Maher, Houston, TX (US); David Sverre, Gibbons (CA); Ricky Brown, Houston, TX (US)

(73) Assignee: Trendsetter Vulcan Offshore, Inc., Houston, TX (US)

( * ) Notice: Subject to any disclaimer, the term of this patent is extended or adjusted under 35 U.S.C. 154(b) by 0 days.

(21) Appl. No.: 18/838,398

(22) PCT Filed: Feb. 17, 2023

(86) PCT No.: PCT/US2023/013349

§ 371 (c)(1),
(2) Date: Aug. 14, 2024

(87) PCT Pub. No.: WO2023/158829

PCT Pub. Date: Aug. 24, 2023

(65) Prior Publication Data

US 2025/0108890 A1 Apr. 3, 2025

Related U.S. Application Data

(60) Provisional application No. 63/311,206, filed on Feb. 17, 2022.

(51) Int. Cl.
*B63B 25/24* (2006.01)
*B65D 90/00* (2006.01)

(52) U.S. Cl.
CPC ..... *B63B 25/24* (2013.01); *B65D 90/00* (2013.01)

(58) Field of Classification Search
CPC ... B63B 2025/285; B63B 25/28; B63B 25/24; B65D 90/0006; B65D 2590/005; B60P 7/18; B61D 45/008
See application file for complete search history.

(56) References Cited

U.S. PATENT DOCUMENTS 2,258,780 A * 10/1941 Loney ..... B61D 45/008 254/98
3,059,593 A * 10/1962 Mack ..... B63B 25/24 410/151

(Continued)

FOREIGN PATENT DOCUMENTS

EP 3912860 A1 11/2021

OTHER PUBLICATIONS

Domino Clamps, How to Install and Use Domino Clamps on a Shipping Container, Mar. 31, 2020.

(Continued)

*Primary Examiner* — Daniel J Colilla
(74) *Attorney, Agent, or Firm* — Jonathan Pierce; Porter Hedges LLP

(57) ABSTRACT

In order to prevent relative movement between two shipping containers located in two adjacent columns of a stack of containers on a cargo ship and separated by a gap, a compression guide is placed at least partially in the gap. The compression guide includes a spacer, one or more attachment mechanisms suitable for partial insertion into a hole in a casting of a container or flat rack, and an interface. The spacer or the interface are preferably shaped to provide two adjacent contact surfaces angled at a lead-in angle so that one of the two adjacent contact surfaces can be used to adjust placement of the compression guide or one of the two shipping containers. Optionally, the width of the spacer can be adjusted, either remotely or manually.

15 Claims, 17 Drawing Sheets

(56) References Cited

U.S. PATENT DOCUMENTS

| | | | | |
|---|---|---|---|---|
| 3,556,456 | A * | 1/1971 | Lunde ..... | B65D 90/0006 410/82 |
| 3,836,043 | A | 9/1974 | Levin | |
| 5,139,359 | A | 8/1992 | Rakar et al. | |
| 11,235,841 | B1 | 2/2022 | Maher et al. | |
| 2016/0325928 | A1 | 11/2016 | Lepek et al. | |

OTHER PUBLICATIONS

USPTO, International Search Report and Written Opinion in IA serial No. PCT/US2023/013349, mailed on May 26, 2023.

* cited by examiner

GAP COMPRESSION GUIDES FOR SHIPPING CONTAINERS

CROSS-REFERENCE TO RELATED APPLICATIONS

This application claims the benefit of priority to U.S. provisional application Ser. No. 63/311,206 filed on Feb. 17, 2022, which is incorporated herein by reference for all and any purposes.

BACKGROUND

The disclosure relates generally to methods and systems for transporting shipping containers stacked on a cargo ship. The disclosure relates more specifically to compression guides for placing at least partially in a gap between two shipping containers located in two adjacent columns of a stack of containers on a cargo ship so as to prevent relative movement between the two shipping containers.

In a typical container stack on a cargo ship, there are roughly eight-inch gaps that align with the ends of the container hatch covers, which cover up the inner tanks of the ship. The spacing between these large gaps can vary but is typically around every 5 stacks.

The large gaps are problematic because there is one side of a container column that is unconstrained and can travel freely, thereby building up momentum as the containers move into the gap.

A fundamental principle of stack dynamics reduction is that the stacks can be made to act like a combined structure, preventing the individual stacks from moving relative to each other. For example, U.S. application Ser. No. 17/316,297 filed on May 10, 2021, describes how the inclusion of lines, ropes, or lashings secured to the corners of a container stack can be used to reduce stack dynamics and add rigidity of capacity to the combined lashing system. U.S. application Ser. No. 17/316,297 is incorporated herein by reference.

Despite these advancements, there is a need in the art for methods and systems for preventing relative movement between the two shipping containers.

SUMMARY

The disclosure describes a compression guide for placing at least partially in a gap between two shipping containers located in two adjacent columns of a stack of containers on a cargo ship.

The compression guide may comprise a spacer. The spacer may have a first side and a second side opposite the first side. The spacer may have a width between the first side and the second side.

In some embodiments, the width of the spacer may be fixed.

In some embodiments, the width of the spacer may be variable. For example, the width of the spacer may be actuatable remotely. Alternatively, the width of the spacer may be actuatable manually.

In some embodiments, the spacer may include a double-acting ram.

In some embodiments, the spacer may include a lead screw mechanism configured to transform rotation movement into linear movement and a wedge mechanism coupled to the lead screw mechanism and configured to transform the linear movement into lateral movement.

The compression guide may also comprise one or more attachment mechanisms suitable for partial insertion into a hole in a casting of a container or flat rack. Each of the one or more attachment mechanisms may be located on the first side and connected to the spacer.

In some embodiments, one of the attachment mechanisms may include one or more of a front plate, a cylindrical boss, a rear plate, a face cam, a screw, and a circlip. For example, the front plate may have a hole. The cylindrical boss may be affixed on the front plate and may surround the hole. The rear plate may have an oblong shape suitable for insertion into the hole in the casting of the container or flat rack. The face cam may be affixed on the rear plate. The face cam may be inserted into the cylindrical boss and sized to provide a cylindrical joint between the rear plate and the front plate. Rotation of the face cam may cause the spacing between the front plate and the rear plate to vary. The screw may pass through the hole in the front plate and may be threaded into the rear plate. The circlip may be located in a groove of the screw so that rotation of the screw after the circlip abut the rear plate causes the rear plate to rotate.

In some embodiments, one of the attachment mechanisms may include a flat rack and a plurality of twist locks.

In some embodiments, the compression guide may comprise fewer than two attachment mechanisms.

In some embodiments, the compression guide may comprise two attachment mechanisms spaced apart to simultaneously engage a top and a bottom of the container or flat rack.

The compression guide may also comprise an interface located on the second side and connected to the spacer. Optionally, the spacer and/or the interface may be shaped to provide two adjacent contact surfaces angled at a lead-in angle. Preferably, the interface is made of elastomer. However, a hard, fixed support with a lead in angle without elastomers may be used, for example, to better allow dropping into place.

The disclosure also describes a method of preventing relative movement between two shipping containers located in two adjacent columns of a stack of containers on a cargo ship and separated by a gap.

The method may include the step of placing a compression guide as described above, at least partially in the gap.

The method may include the step of using one of the two adjacent contact surfaces to adjust the placement of the compression guide or one of the two shipping containers.

The method may include the step of adjusting the width of the spacer.

BRIEF DESCRIPTION OF THE DRAWINGS

For a more detailed description of the embodiments of the disclosure, reference will now be made to the accompanying drawings, wherein.

DETAILED DESCRIPTION

Figure 1:
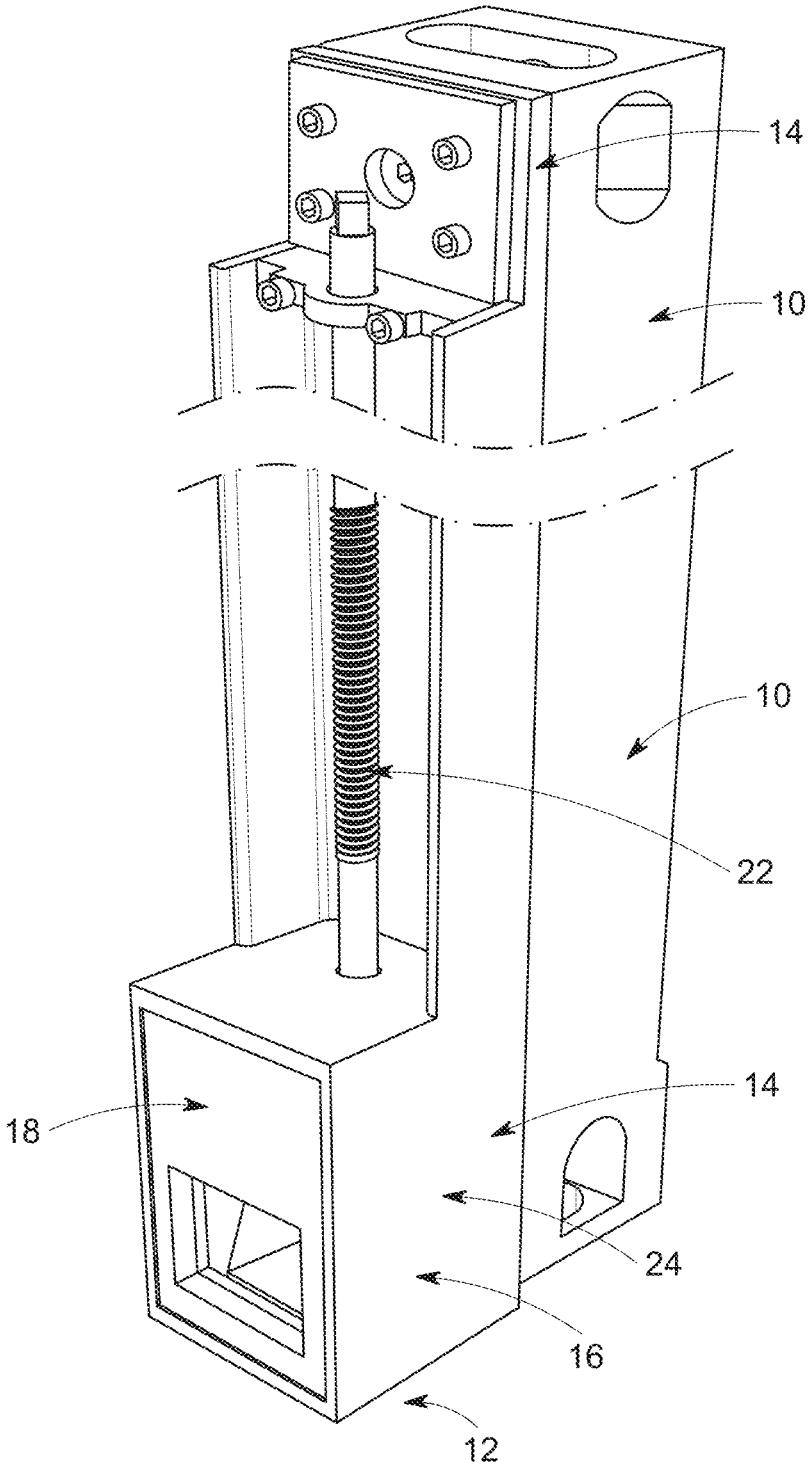
FIG. 1 shows the top and bottom portions of a full-height, hand-actuated guide in retracted position.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

The compression guides that are described in this disclosure can prevent the movement of a container column, thereby making an entire new lashing system, such as described in U.S. application Ser. No. 17/316,297, more effective. The compression guides are introduced into the gaps between the container columns.

The need for a line, rope, or lashing that is on the top of the container stack, as is described in U.S. application Ser. No. 17/316,297, can be reduced or even eliminated by introducing compression guides or spacers into the gaps between the container columns.

The compression guides include a mechanism that can attach, directly or indirectly via a flat rack, to the corner castings at either the top, the bottom, or both the top and the bottom, of any level of containers.

In general, the compression guides can have one or a combination of the following configurations:

a full-height simple structural guide,
a single-corner simple structural guide,
a single-corner remotely actuated guide,
a full-height remotely actuated guide,
a single-corner hand-actuated guide, and/or
a full-height hand-actuated guide.

Remote actuation for adjusting the width of the compression guides can be implemented with any common method, including pre-charged hydraulic fluid with locking cylinders or pneumatic using airbags that can be charged and then locked. One approach is to include the actuation directly into the flat rack. This approach provides more strength than can be achieved by attaching it to the corner casting.

If additional strength is needed, the compression guides can include a flat rack to be attached to a container and provide bearing resistance.

Alternatively, the compression guides can attach to the corner castings of a container using a mechanism similar to domino clamps®, available at the web page <dominoclamps.com>. While the figures show the compression guides attached at the level of the top container of a stack, the compression guides can be attached at any level.

Figure 2:
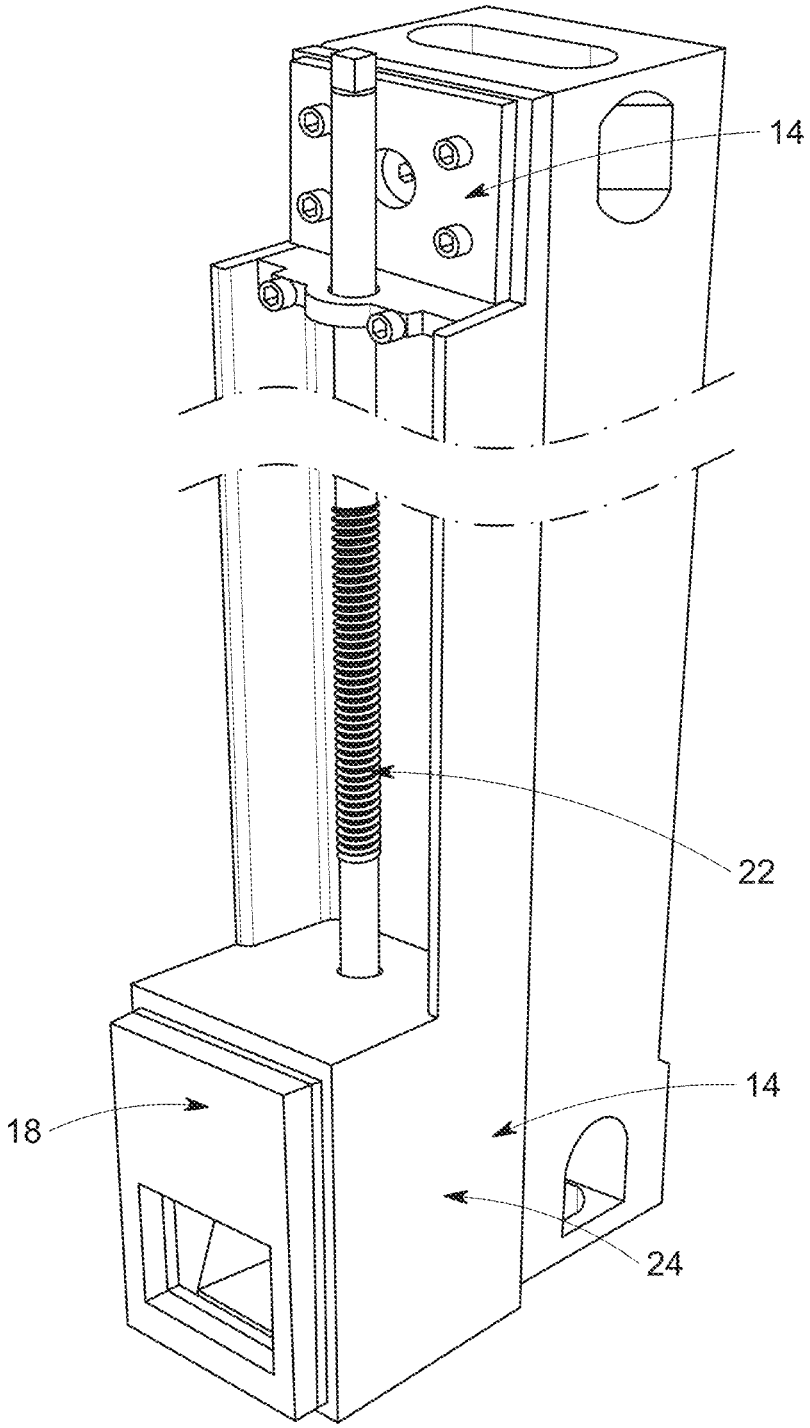
FIG. 2 shows the top and bottom portions of the full-height, hand-actuated guide of FIG. 1 in extended position.
Figure 3:
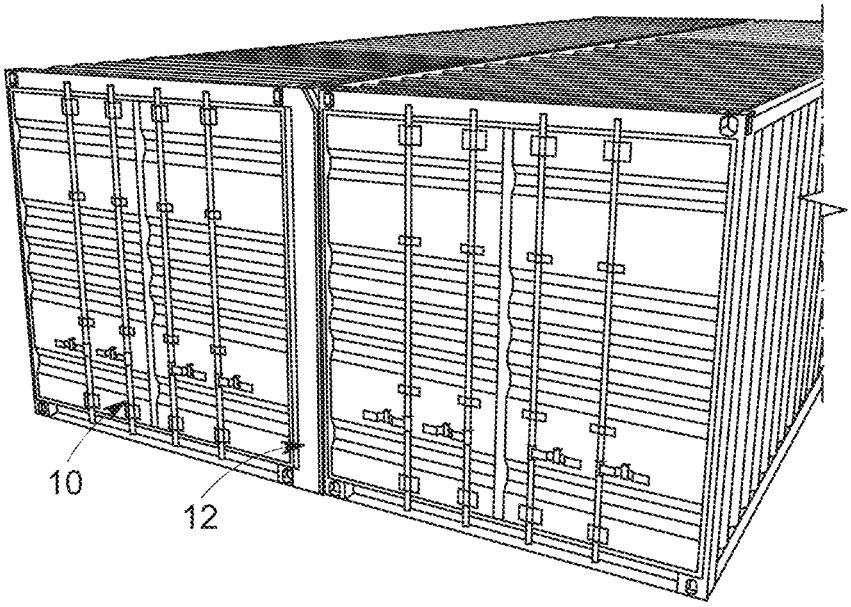
FIG. 3 shows a full-height simple structural guide disposed in a gap between first and second containers.
Figure 23:
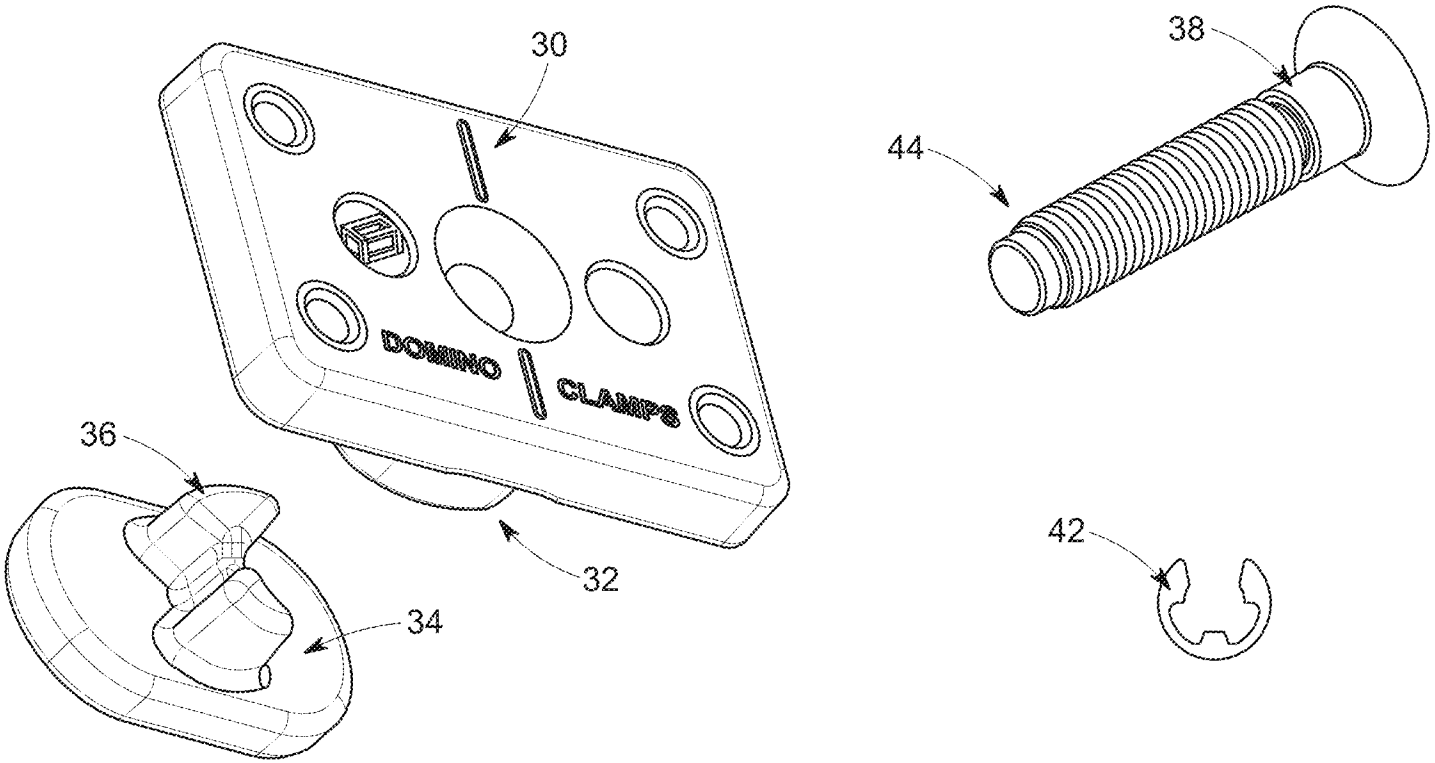
FIG. 23 is an exploded view of an attachment mechanism in accordance with one embodiment.

In reference to FIGS. 1 and 2, an example of a compression guide 12 comprises a spacer 16. The width of the spacer 16 is variable. In this example, the width of the spacer 16 is actuatable manually. In order to do so, the spacer 16 includes a lead screw mechanism 22 configured to transform rotation movement into linear movement, and a wedge mechanism 24 (not visible) coupled to the lead screw mechanism 22 and configured to transform the linear movement into lateral movement. The compression guide 12 also comprises attachment mechanisms 14 suitable for partial insertion into a hole in a casting of a container 10. In this example, the compression guide 12 comprises two attachment mechanisms 14 spaced apart to simultaneously engage a top and a bottom of the container 10. Details of the attachment mechanisms 14 are shown in FIG. 23 and are similar to domino clamps®. The compression guide 12 also comprises an interface 18 located on the side of the spacer 16 opposite the attachment mechanisms 14. Preferably, the interface is mode of elastomer.

Figure 4:
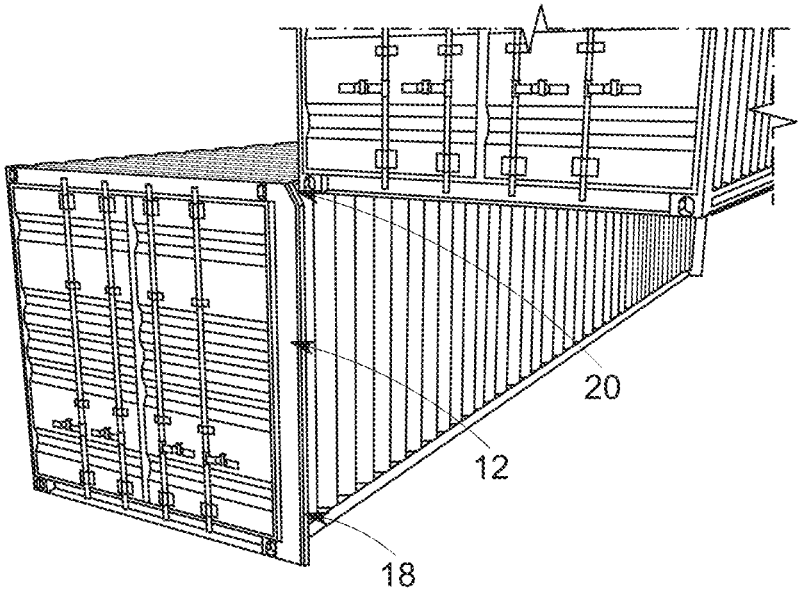
FIG. 4 shows the full-height simple structural guide of FIG. 3 before the second container is placed in the stack.
Figure 5:
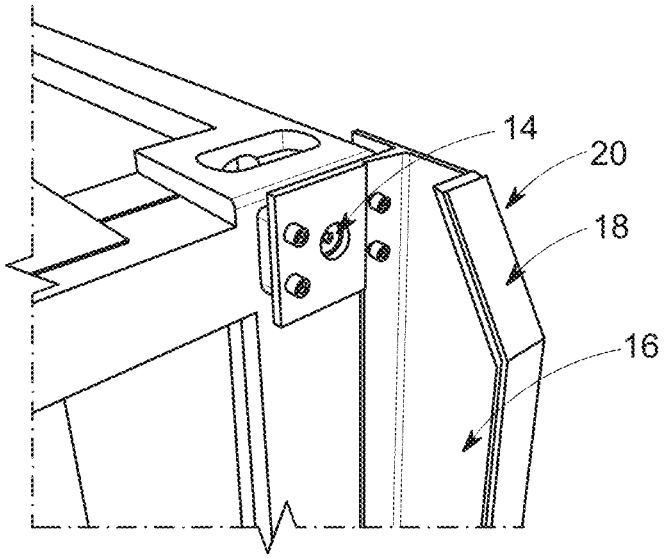
FIG. 5 shows the top portion of the full-height simple structural guide of FIG. 3 before the second container is placed in the stack.
Figure 6:
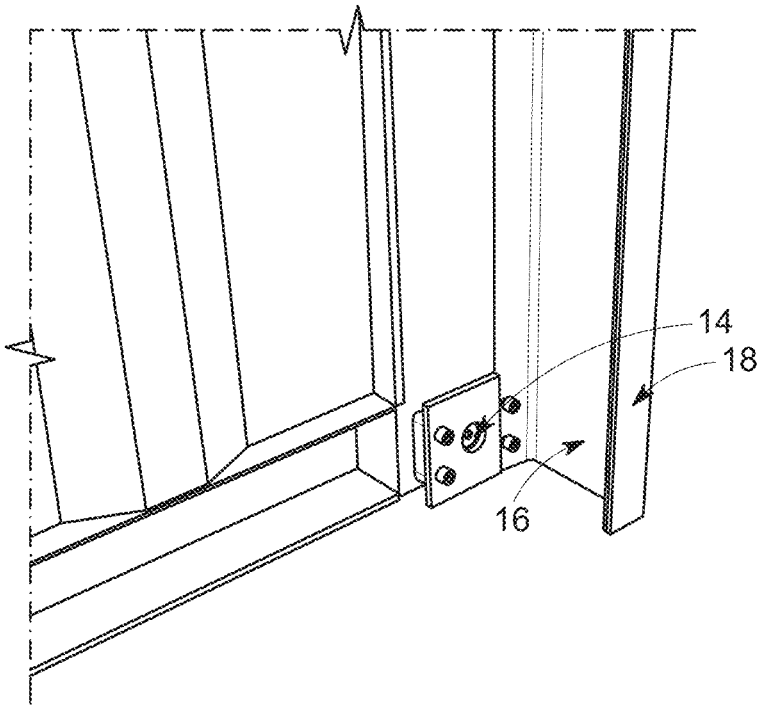
FIG. 6 shows the bottom portion of the full-height simple structural guide of FIG. 3 before the second container is placed in the stack.
Figure 7:
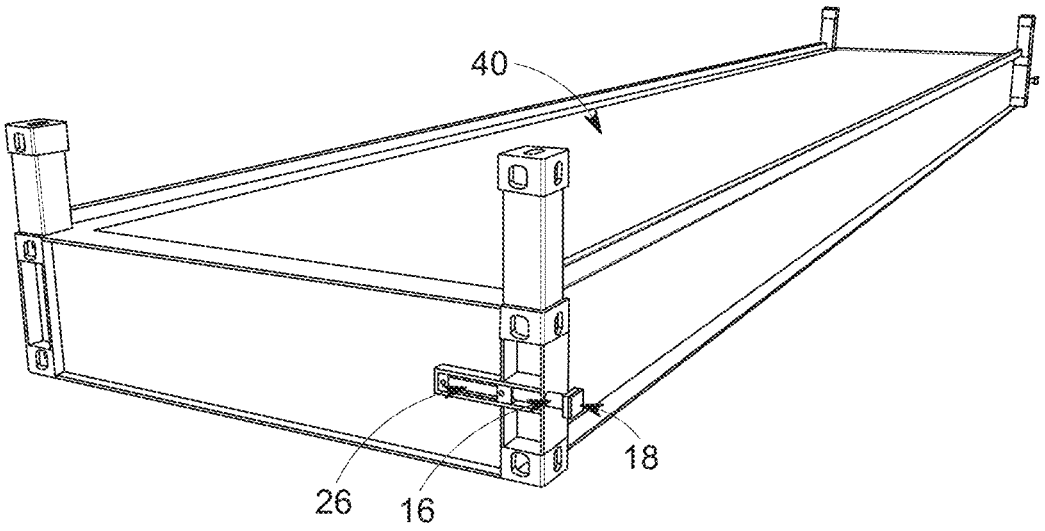
FIG. 7 shows a portion of a single-corner, remotely-actuated guide.
Figure 8:
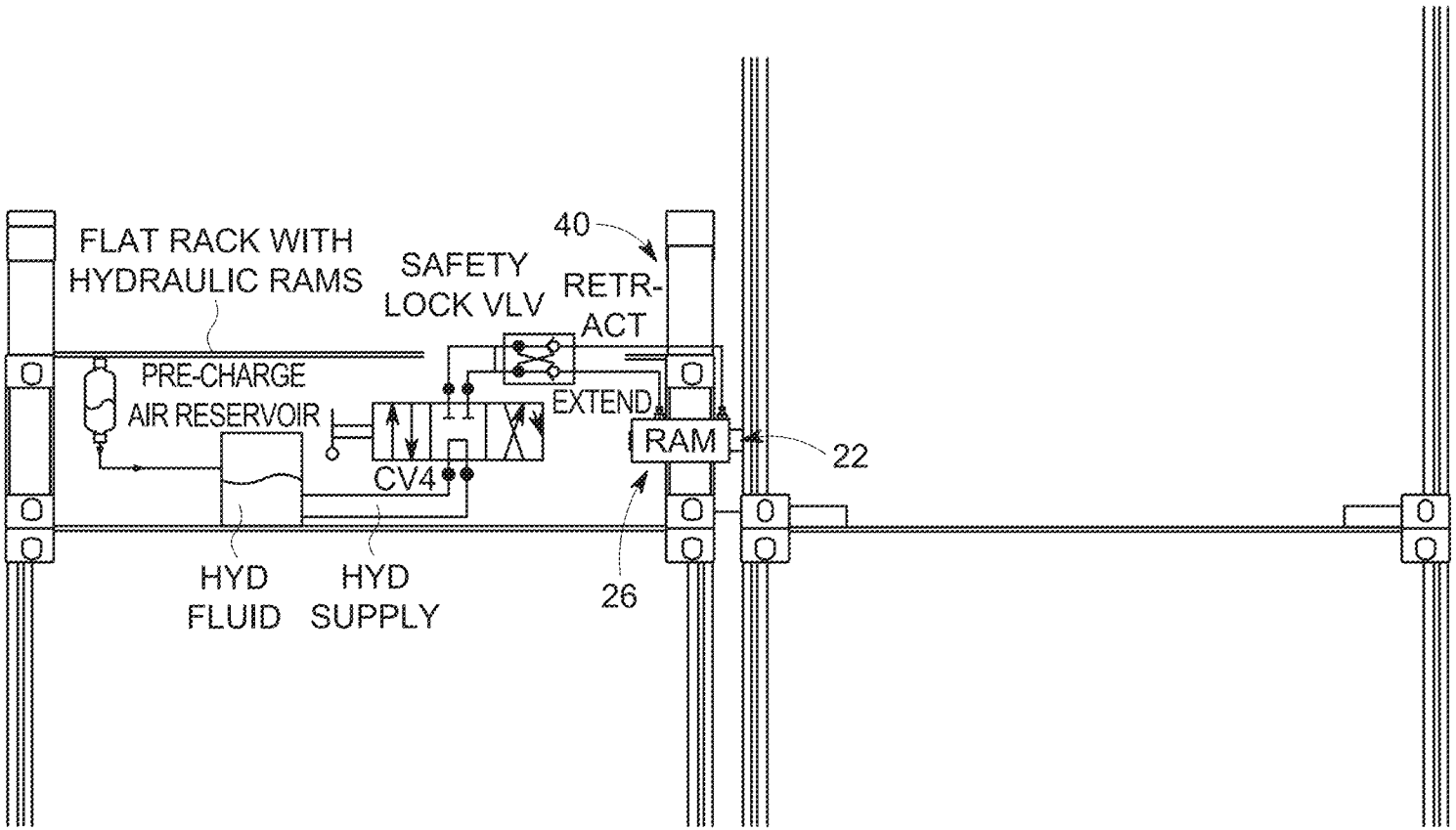
FIG. 8 shows a schematic of the single-corner, remotely-actuated guide of FIG. 7.
Figure 9:
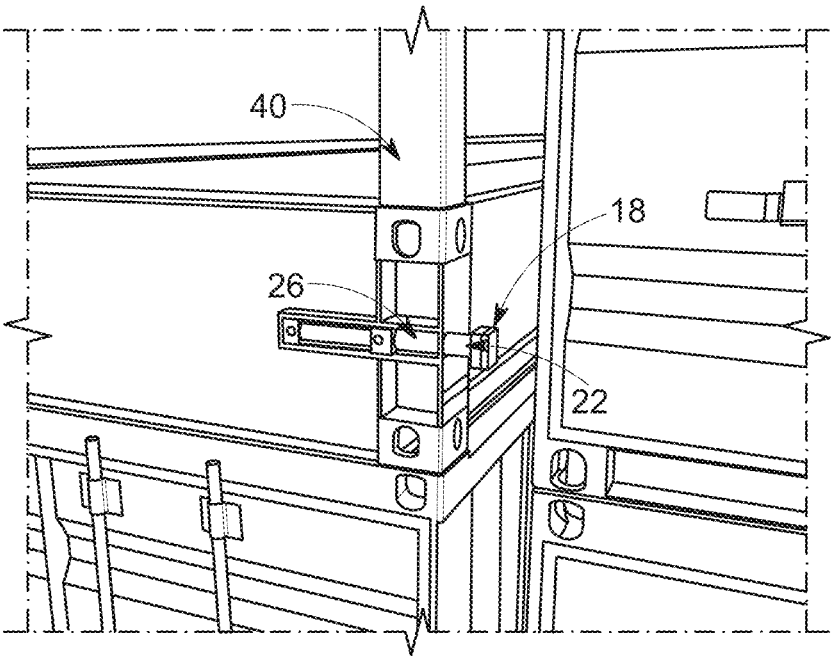
FIG. 9 shows the portion of a single-corner, remotely-actuated guide of FIG. 7 in retracted position.
Figure 10:
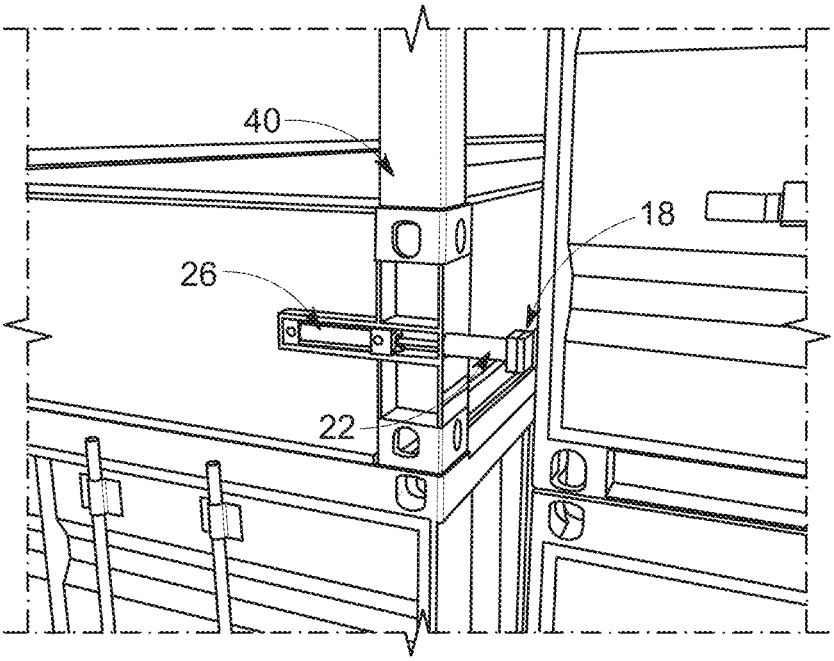
FIG. 10 shows the portion of a single-corner, remotely-actuated guide of FIG. 7 in extended position.

In reference to FIGS. 3-6, an example of a compression guide 12 comprises a spacer 16 in the form of a C channel. The width of the spacer 16 is fixed. for example, approximately seven inches. Again, the compression guide 12 comprises two attachment mechanisms 14 spaced apart to simultaneously engage a top and a bottom of the container 10. Details of the attachment mechanisms 14 are shown in FIG. 23 and are similar to domino clamps®. The interface 18 is preferably made of elastomer. The spacer 16 and an interface 18 are shaped to provide two adjacent contact surfaces angled at a lead-in angle 20. The interface 18 is preferably made of elastomer. As best seen in FIG. 4, one of the two adjacent contact surfaces can be used to adjust the placement of a shipping container.

In reference to FIGS. 7-10, an example of a compression guide 12 comprises a spacer 16 that has a variable width. For example, the spacer 16 includes a double-acting ram 26 that is actuatable remotely using a hydraulic circuit (best seen in FIG. 8). However, in other embodiments, a pneumatic circuit may be used instead. In this example, the compression guide 12 comprises a single attachment mechanism suitable for partial insertion into holes in the castings of container 10. In this example, the attachment mechanism includes a flat rack 40 and a plurality of twist locks.

Figure 11:
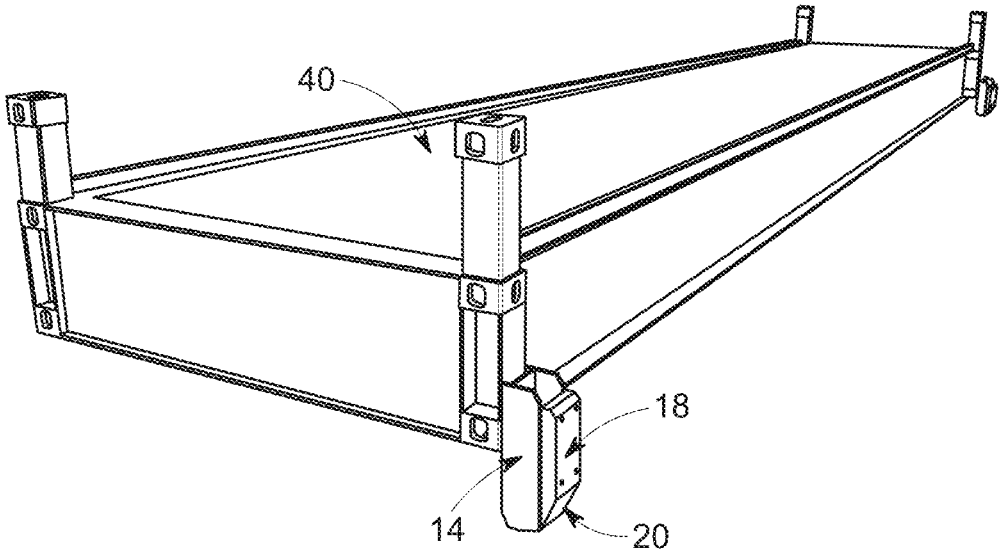
FIG. 11 shows a single-corner simple structural guide.
Figure 12:
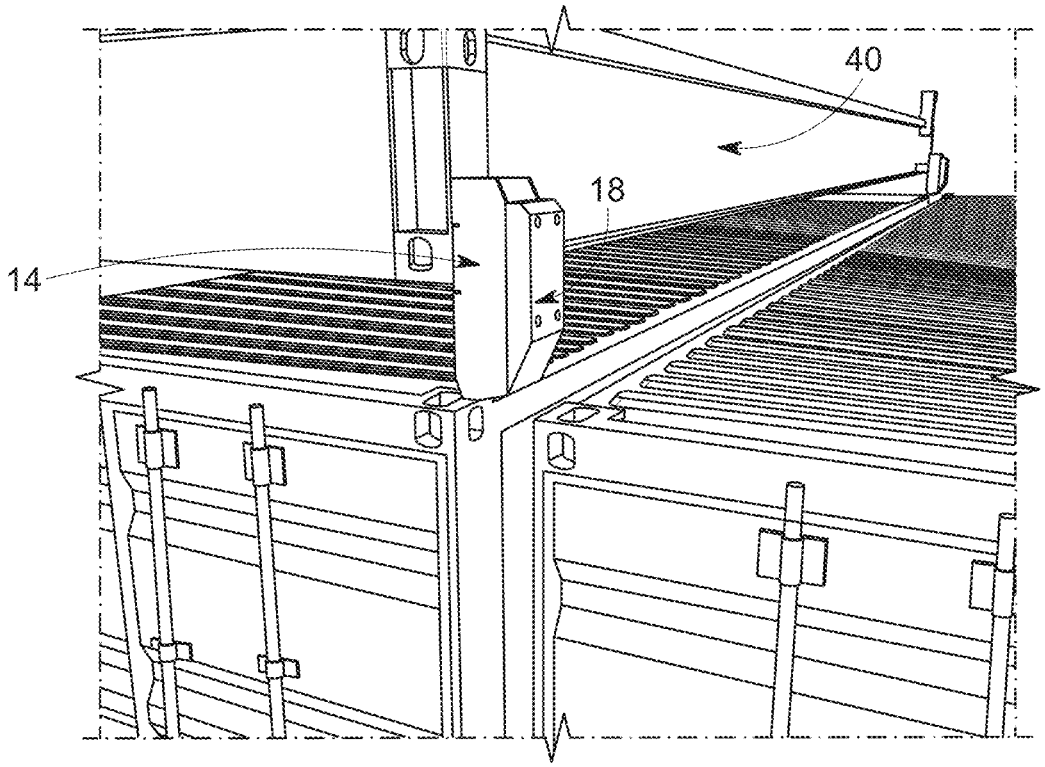
FIG. 12 shows the single-corner simple structural guide of FIG. 11 before its introduction into a gap.
Figure 13:
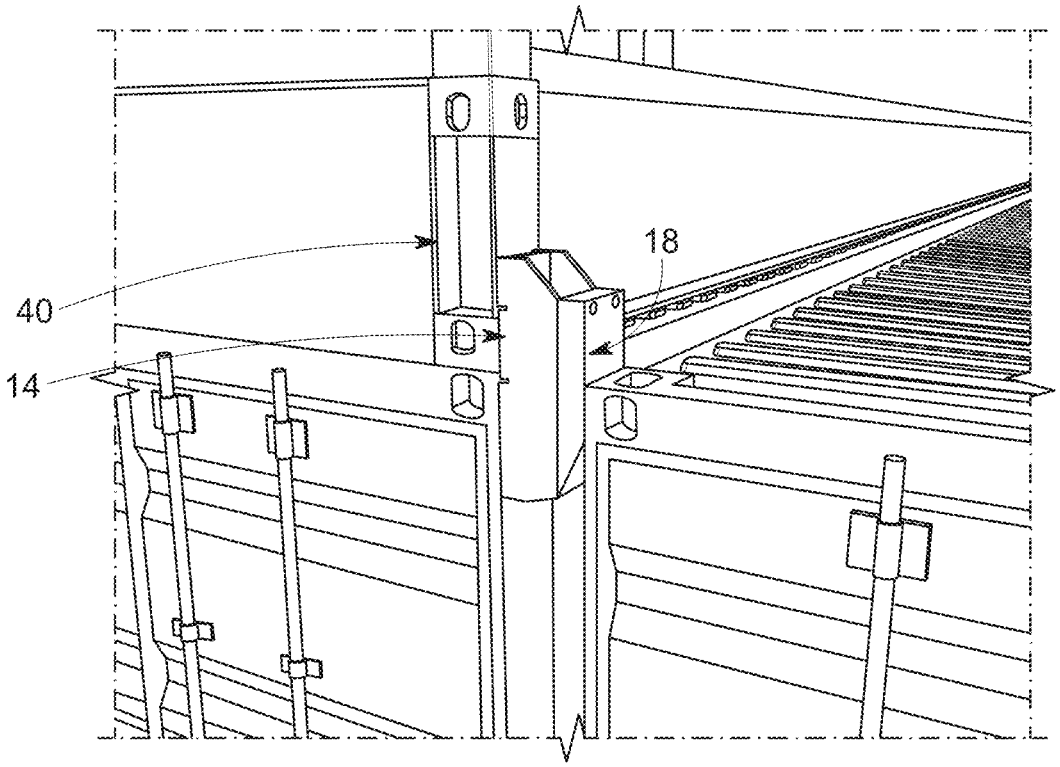
FIG. 13 shows the single-corner simple structural guide of FIG. 11 after its introduction into a gap.

In reference to FIGS. 11-13, an example of a compression guide 12 comprises a spacer that has a fixed width. In this example, the compression guide 12 comprises a single mechanism 14 suitable for partial insertion into a hole in a casting of a flat rack 40. Details of the attachment mechanisms 14 are shown in FIG. 23 and are similar to domino clamps®. The spacer and an interface 18 are shaped to provide two adjacent contact surfaces angled at a lead-in angle. The interface 18 is preferably made of elastomer. As best seen in FIGS. 12-13, one of the two adjacent contact surfaces can be used to adjust the placement of the compression guide 12 between two adjacent containers.

Figure 14:
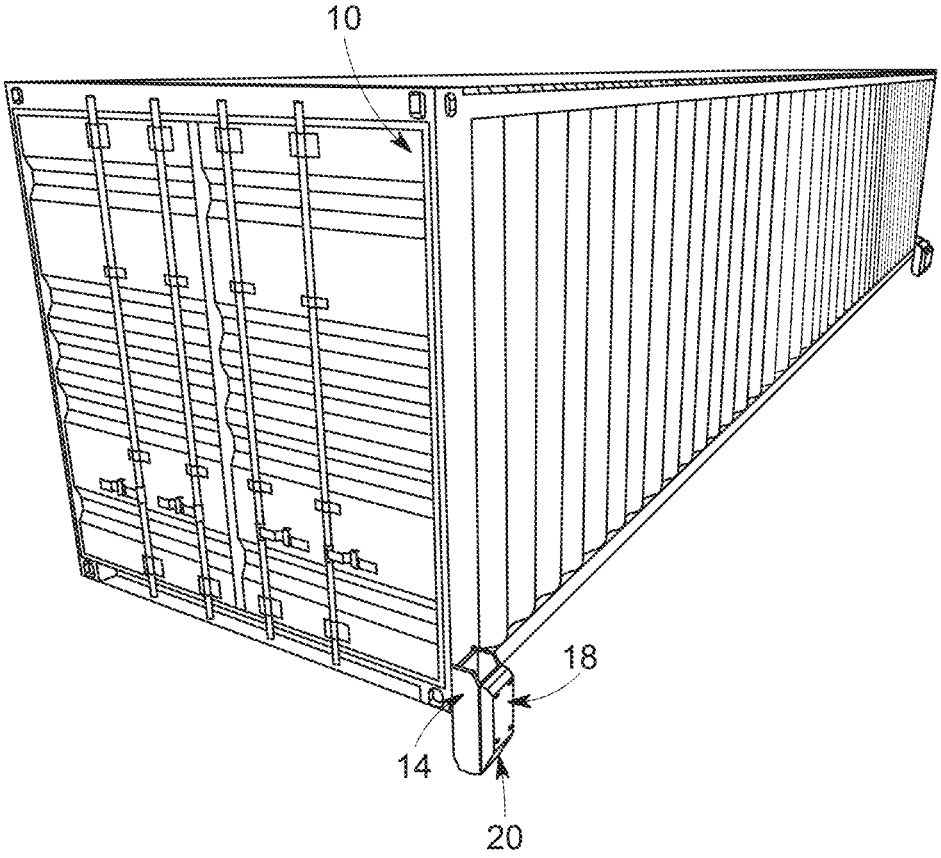
FIG. 14 shows another single-corner simple structural guide.
Figure 15:
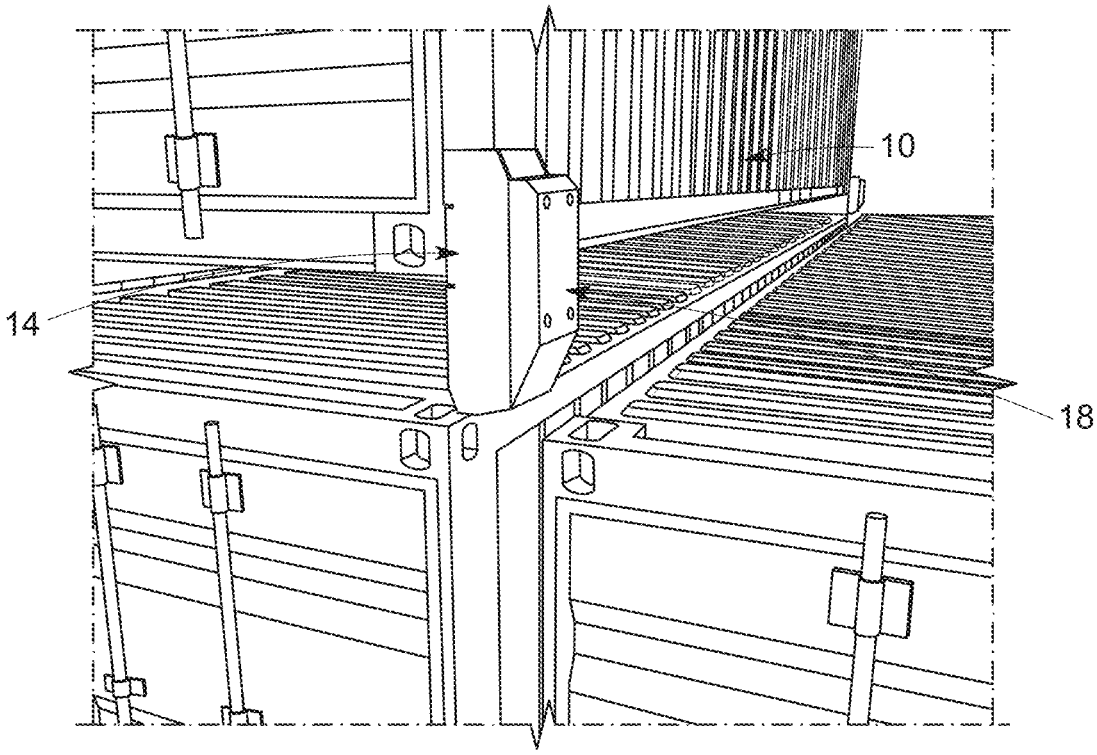
FIG. 15 shows the single-corner simple structural guide of FIG. 14 before its introduction into a gap.
Figure 16:
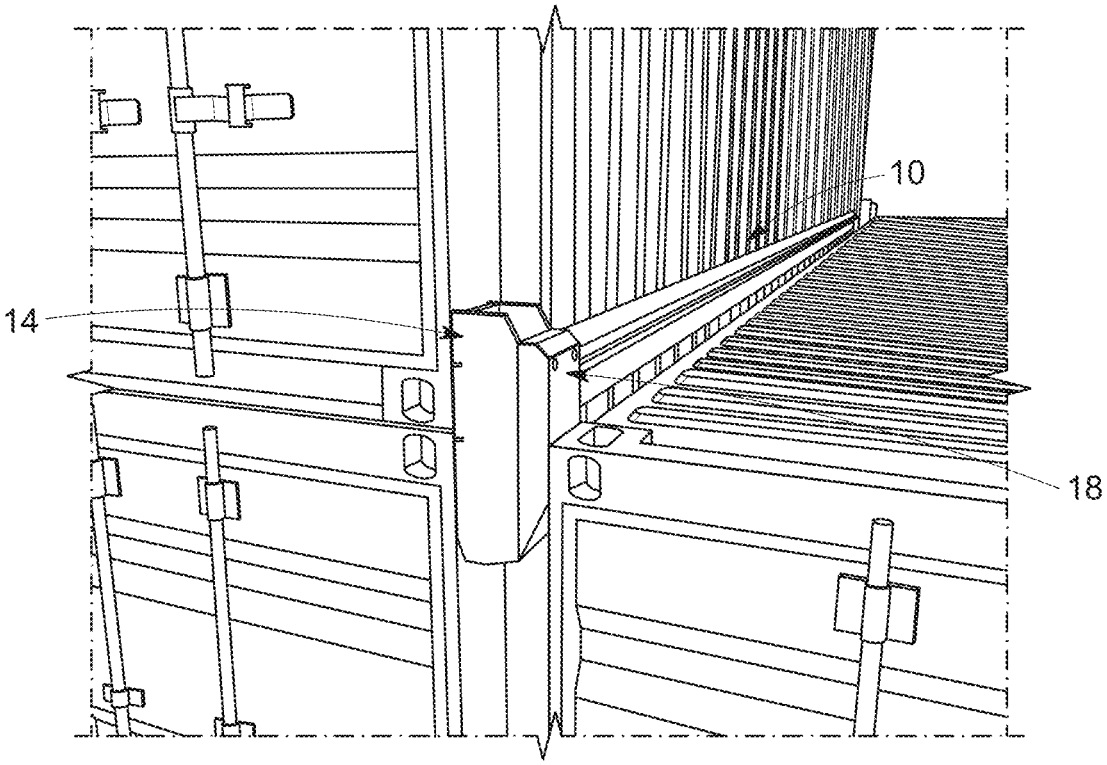
FIG. 16 shows the single-corner simple structural guide of FIG. 14 after its introduction into a gap.
Figure 17:
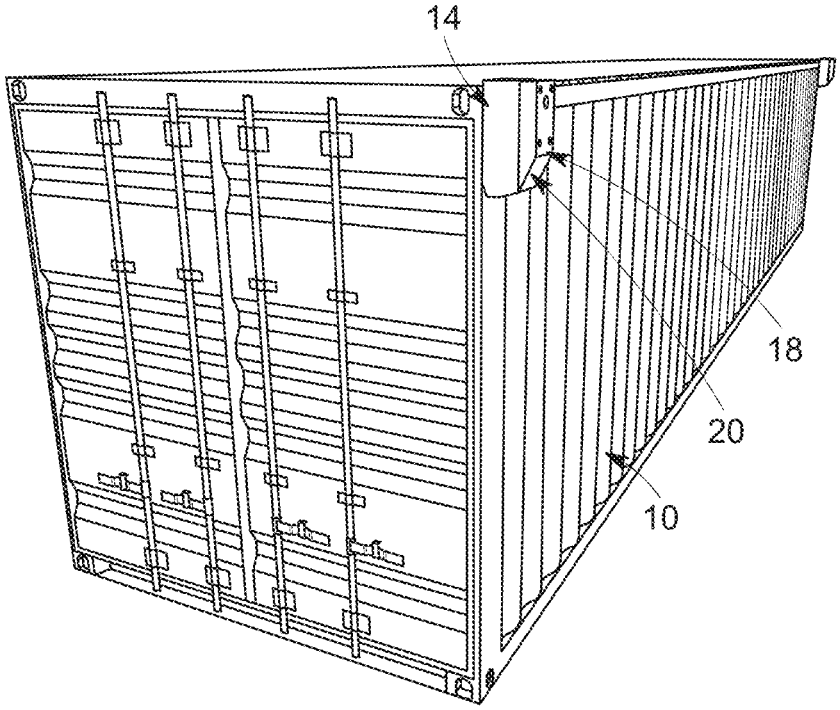
FIG. 17 shows yet another single-corner simple structural guide.
Figure 18:
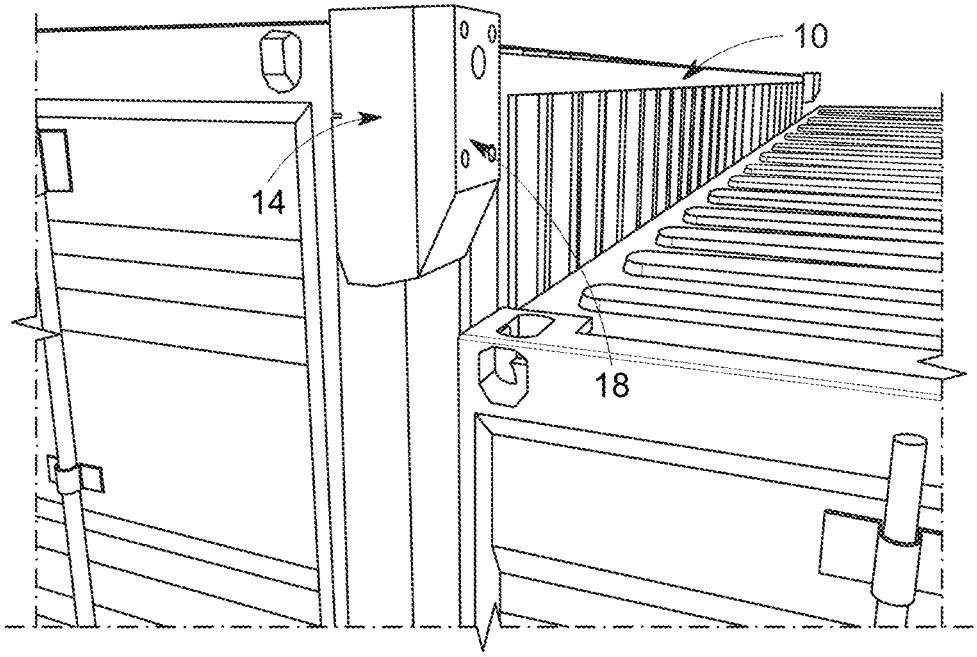
FIG. 18 shows the single-corner simple structural guide of FIG. 17 before its introduction into a gap.
Figure 19:
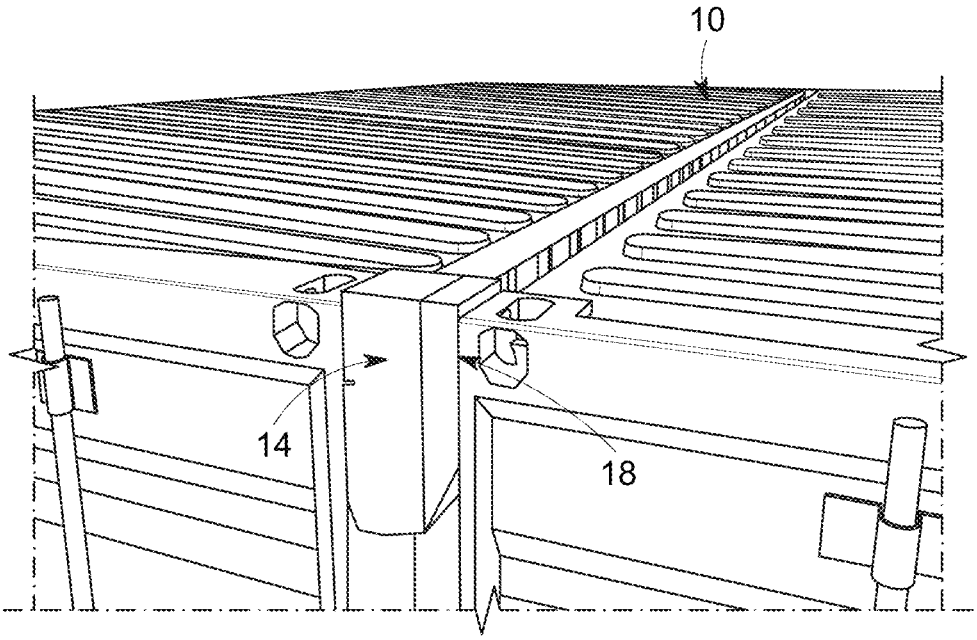
FIG. 19 shows the single-corner simple structural guide of FIG. 17 after its introduction into a gap.

In the example illustrated in FIGS. 14-16, the compression guide 12 shown in FIGS. 11-13 is attached to the bottom of the container 10 instead of the flat rack 40. In the example illustrated in FIGS. 17-19, a compression guide 12 similar to the compression guide shown in FIGS. 11-13 is attached to the top of container 10 instead of the flat rack 40. As such, a single design of a compression guide provides the flexibility of use in a variety of locations in a stack of containers.

Figure 20:
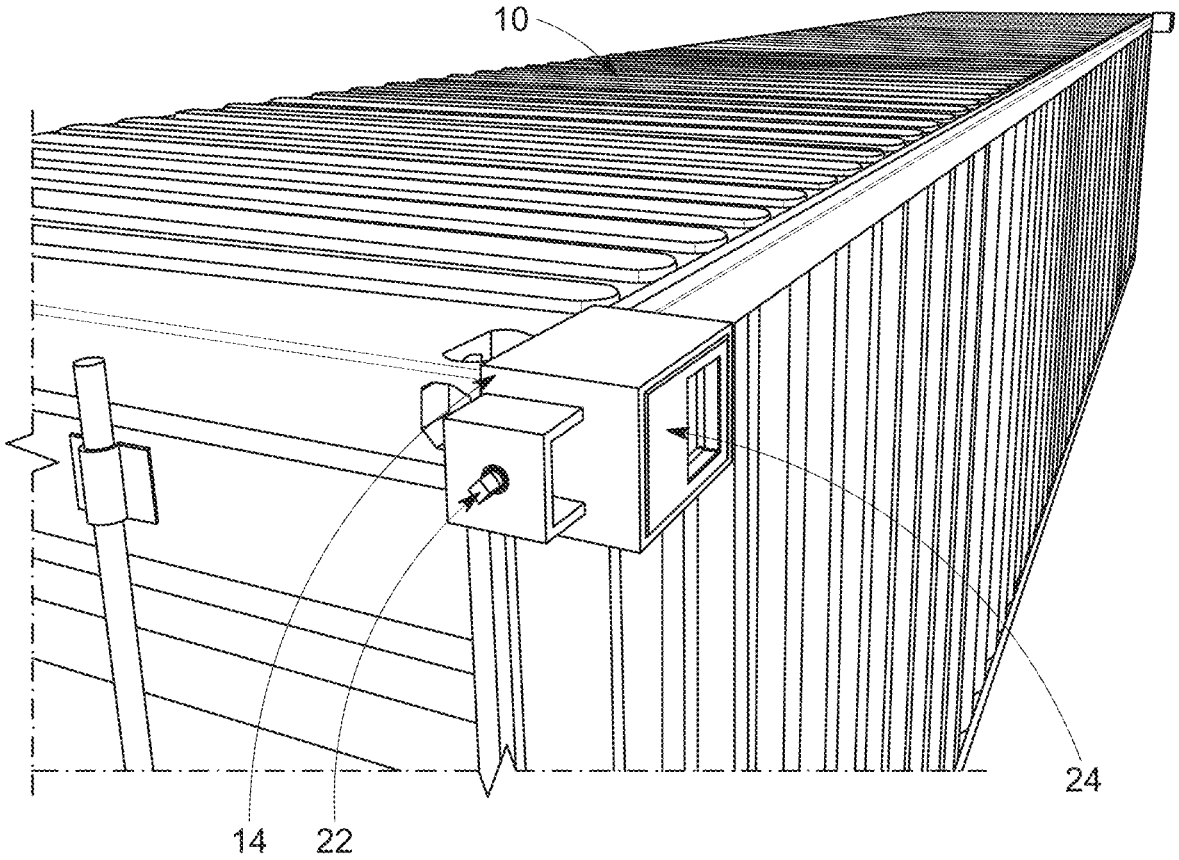
FIG. 20 shows a single-corner, hand-actuated guide.
Figure 21:
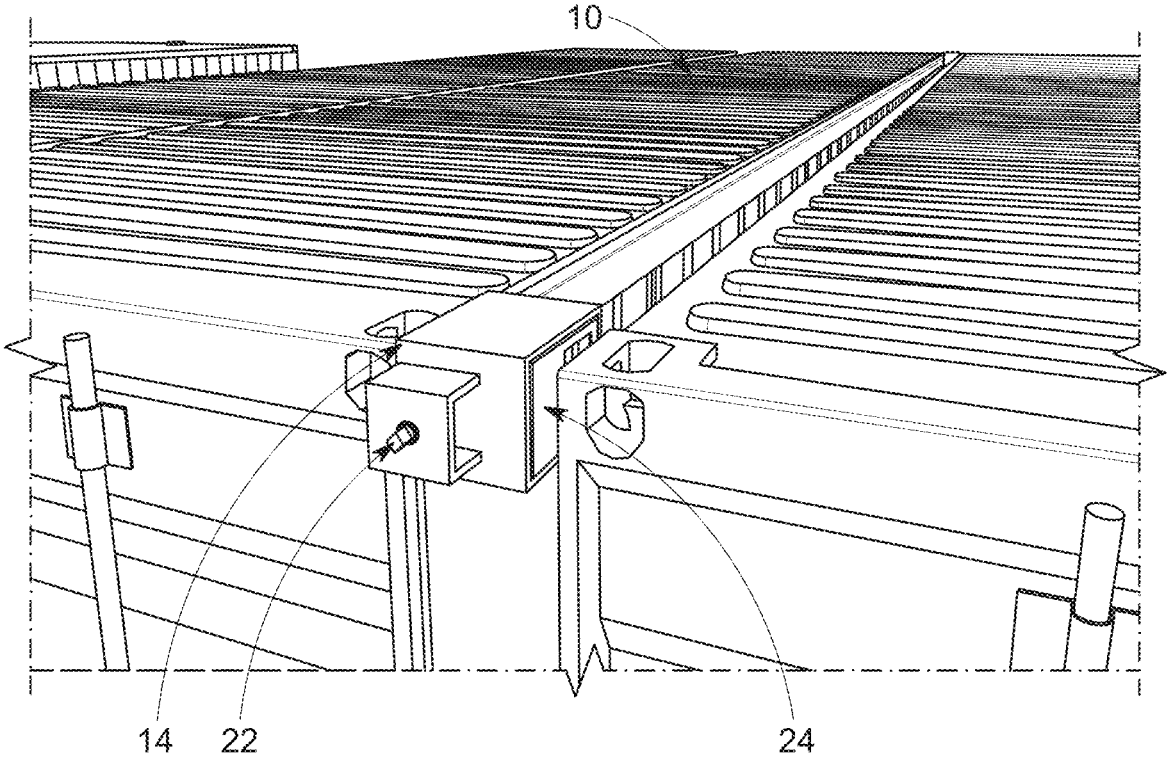
FIG. 21 shows the single-corner, hand-actuated guide of FIG. 20 in retracted position.
Figure 22:
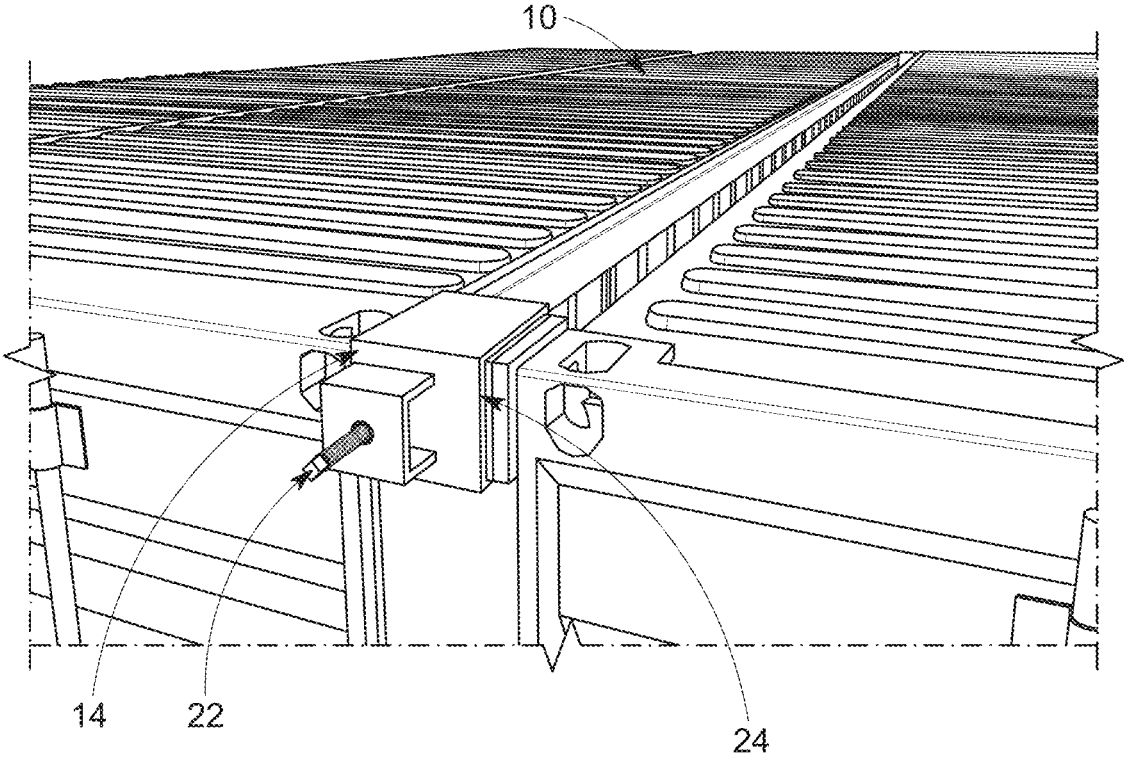
FIG. 22 shows the single-corner, hand-actuated guide of FIG. 20 in extended position.

In reference to FIGS. 20-22, an example of a compression guide 12 comprises a spacer that has a variable width. For example, the spacer is actuatable manually. In this example, the spacer includes a lead screw mechanism 22 configured to transform rotation movement into linear movement, and a wedge mechanism 24 (not visible) coupled to the lead screw mechanism 22 and configured to transform the linear movement into lateral movement. In this example, the compression guide 12 comprises a single attachment mechanism 14. Details of the attachment mechanism 14 are shown in FIG. 23 and are similar to domino clamps®.

In reference to FIG. 23, an attachment mechanism similar to domino clamps® includes a front plate 30, a cylindrical boss 32, a rear plate 34, a face cam 36, a screw 38, and a circlip 42. The front plate 30 has a hole. The cylindrical boss 32 is affixed on the front plate 30 and surrounds the hole. The rear plate 34 has an oblong shape suitable for insertion into a hole in the casting of container 10 or flat rack 40 (as shown in the previous FIGs.). The face cam 36 is affixed on the rear plate 34. In use, the face cam 36 is inserted into the cylindrical boss 32 and provides a cylindrical joint between the rear plate 34 and the front plate 30. Rotation of the rear plate 34 and face cam 36 causes a spacing between the front plate 30 and the rear plate 34 to vary, thus clamping a wall of the casting of the container 10 or flat rack 40. In use, screw 38 passes through the bole in the front plate 30 and is threaded to the rear plate 34. The circlip 42 is located in groove 44 of screw 38, so that rotation of screw 38 after the circlip 42 abuts the rear plate 34 causes the rear plate 34 to rotate.

What is claimed is:

1. A compression guide for placing at least partially in a gap between two shipping containers located in two adjacent columns of a stack of containers on a cargo ship, the compression guide comprising:

a spacer having a first side and a second side opposite the first side, the spacer having a width between the first side and the second side; and one or more attachment mechanisms adapted for partial insertion into a hole in a casting of a container or flat rack; each of the one or more attachment mechanisms being located on the first side and connected to the spacer, wherein the width of the spacer is variable, wherein the width of the spacer is actuatable manually, wherein the spacer includes a lead screw mechanism configured to transform rotation movement into linear movement and a wedge mechanism coupled to the lead screw mechanism and configured to transform the linear movement into lateral movement.

2. The compression guide of claim 1, further comprising an elastomer interface located on the second side and connected to the spacer.

3. The compression guide of claim 2, wherein the elastomer interface is shaped to provide two adjacent contact surfaces angled at a lead-in angle.

4. The compression guide of claim 2, wherein the compression guide comprises two attachment mechanisms spaced apart to simultaneously engage a top and a bottom of the container.

5. The compression guide of claim 1, wherein at least one of the one or more attachment mechanisms includes:

a front plate having a hole;

a cylindrical boss affixed on the front plate and surrounding the hole;

a rear plate having an oblong shape suitable for insertion into the hole in the casting of the container or flat rack;

a face cam affixed on the rear plate, wherein the face cam is inserted into the cylindrical boss and sized to provide a cylindrical joint between the rear plate and the front plate, wherein rotation of the face cam causes a spacing between the front plate and the rear plate to vary;

a screw passing through the hole and threaded to the rear plate; and a circlip located in a groove of the screw, so that rotation of the screw after the circlip abut the rear plate causes the rear plate to rotate.

6. The compression guide of claim 5, wherein the spacer is shaped to provide two adjacent contact surfaces angled at a lead-in angle.

7. The compression guide of claim 5, wherein the compression guide comprises two attachment mechanisms spaced apart to simultaneously engage a top and a bottom of the container.

8. The compression guide of claim 1, wherein at least one of the one or more attachment mechanisms includes:

a flat rack; and a plurality of twist locks.

9. The compression guide of claim 8, wherein the spacer is shaped to provide two adjacent contact surfaces angled at a lead-in angle.

10. The compression guide of claim 8, wherein the compression guide comprises two attachment mechanisms spaced apart to simultaneously engage a top and a bottom of the container or flat rack.

11. The compression guide of claim 1, wherein the spacer is shaped to provide two adjacent contact surfaces angled at a lead-in angle.

12. The compression guide of claim 1, wherein the compression guide comprises two attachment mechanisms spaced apart to simultaneously engage a top and a bottom of the container.

13. A method of preventing relative movement between two shipping containers located in two adjacent columns of a stack of containers on a cargo ship and separated by a gap, the method comprising:

placing a compression guide at least partially in the gap, the compression guide including:

a spacer having a first side and a second side opposite the first side, the spacer having a width between the first side and the second side; and one or more attachment mechanisms adapted for partial insertion into a hole in a casting of a container or flat rack; each of the one or more attachment mechanisms being located on the first side and connected to the spacer, wherein the width of the spacer is variable, wherein the width of the spacer is actuatable manually, wherein the spacer includes a lead screw mechanism configured to transform rotation movement into linear movement and a wedge mechanism coupled to the lead screw mechanism and configured to transform the linear movement into lateral movement.

14. The method of claim 13, wherein the spacer or an interface located on the second side and connected to the spacer are shaped to provide two adjacent contact surfaces angled at a lead-in angle, the method further comprising using one of the two adjacent contact surfaces to adjust placement of the compression guide or one of the two shipping containers.

15. The method of claim 13 further comprising adjusting the width of the spacer.

* * * * *